US010071458B2

(12) United States Patent
Yazawa et al.

(10) Patent No.: US 10,071,458 B2
(45) Date of Patent: Sep. 11, 2018

(54) CALIBRATION APPARATUS AND CALIBRATION METHOD

(71) Applicant: Ebara Corporation, Tokyo (JP)

(72) Inventors: Akihiro Yazawa, Tokyo (JP); Kenichi Kobayashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 167 days.

(21) Appl. No.: 15/353,913

(22) Filed: Nov. 17, 2016

(65) Prior Publication Data

US 2017/0151646 A1 Jun. 1, 2017

(30) Foreign Application Priority Data

Nov. 27, 2015 (JP) ..... 2015-231844

(51) Int. Cl.

| | |
|---|---|
| ***B24B 49/16*** | (2006.01) |
| ***B24B 9/00*** | (2006.01) |
| ***B24B 37/005*** | (2012.01) |
| ***B24B 9/06*** | (2006.01) |

(52) U.S. Cl.
CPC ..... *B24B 37/005* (2013.01); *B24B 9/065* (2013.01)

(58) Field of Classification Search
CPC ..... B24B 49/16; B24B 49/00; B24B 9/065; B24B 9/00
USPC ..... 451/44, 43, 5, 168, 173, 442
See application file for complete search history.

(56) References Cited

U.S. PATENT DOCUMENTS 6,306,016 B1 * 10/2001 Steere, Jr. ..... B24B 9/065 451/168

FOREIGN PATENT DOCUMENTS

JP 2012-231191 A 11/2012

* cited by examiner

*Primary Examiner* — Robert Rose
(74) *Attorney, Agent, or Firm* — Leydig, Voit & Mayer, Ltd.

(57) ABSTRACT

An object of the invention is to provide a calibration apparatus which enables the pressing force of the polishing pad to be adjusted by a simple method without the need of removing a stage on which a substrate can be placed. One embodiment of the invention provides a calibration apparatus for a bevel polishing system for polishing a bevel portion of a substrate, comprising: a load measuring device capable of measuring a pressing load from a polishing pad of the bevel polishing system; and a base plate capable of having the load measuring device placed thereon, wherein the base plate is capable of being fixed on a vacuum suction table which is capable of having a substrate placed thereon.

19 Claims, 8 Drawing Sheets

CALIBRATION APPARATUS AND CALIBRATION METHOD

TECHNICAL FIELD

The invention relates to a calibration apparatus and a calibration method. Specifically, the invention relates to a calibration apparatus and method for a bevel polishing system for polishing a bevel portion of a substrate.

BACKGROUND ART

According to conventional bevel polishing systems for polishing a bevel portion of a substrate such as a wafer, a pad called a polishing or pressing pad is pressed against the bevel portion of the substrate through a polishing tape with a proper load. The systems thus control the amount of polishing of the substrate and the shape of the substrate. The polishing pad is controlled by means of, for example, pneumatic control using an electropneumatic regulator. The electropneumatic regulator is used to adjust an air pressure supplied to an air cylinder to desired pressure, to thereby control the pressing force of the polishing pad and thus control the pressure which presses the polishing surface of the polishing tape against the substrate (Patent Document 1).

Thus, as described above, the bevel polishing systems use the electropneumatic regulator for precise control on air pressure in the air cylinder so as to maintain polishing performance. It is therefore required to obtain an accurate correlation between the air pressure in the air cylinder and the pressing load at an end of the polishing pad. As a method for fulfilling this requirement, calibration of a load from the polishing pad is currently performed by actually measuring the pressing load with a force gauge under controlled air pressure conditions.

CITATION LIST

Patent Document

Patent Document 1: Japanese Patent Application Publication (Kokai) No. 2012-231191

SUMMARY OF INVENTION

According to the calibration work explained above, conventionally, a stage on which a substrate is placed is removed from a substrate-holding and rotating mechanism. The stage is replaced with an attachment jig equipped with a force gauge. After the attachment jig is mounted on the rotating mechanism, a series of adjustment operations are carried out with respect to the pressing force of the polishing pad. However, an operation for removal of the stage and attachment of the attachment jig is time-consuming. Further, to perform a reliable calibration work, the attachment jig needs to be mounted so that the force gauge can be accurately positioned. In addition, at the time of reattachment of the stage, adjustment on the stage is required again, including the adjustment of eccentricity and leveling of the stage. This not only complicates the calibration work but also causes downtime, resulting in a decrease in number of the substrates processed per unit time.

One embodiment of the invention provides a calibration apparatus which enables the pressing force of the polishing pad to be adjusted by a simple method without the need of removing a stage on which a substrate can be placed. Further, one embodiment of the invention provides a calibration method that makes it possible to adjust the pressing force of the polishing pad by a simple method without removing the stage on which the substrate can be placed.

According to one embodiment of the invention, there is provided a calibration apparatus for use in a bevel polishing apparatus, the bevel polishing apparatus being configured to polish a bevel portion of a substrate, the calibration apparatus comprising a load measuring device configured to measure a pressing load from a polishing pad of the bevel polishing apparatus, and a base plate configured to be fixed on a vacuum suction table configured to hold the substrate placed thereon, the base plate having the load measuring device placed thereon. With the above arrangement, the calibration apparatus can be mounted on a mechanism for rotating a substrate by using the suction mechanism of an existing vacuum suction table. This eliminates the necessity of removal of the vacuum suction table which is required in the conventional art. Since the mounting of the calibration apparatus can be easily conducted as compared to the conventional calibration work, a risk of occurrence of human error during the mounting of the calibration apparatus can be reduced. Further, differing from the conventional art, there is no possibility of human error accompanying the mounting of the vacuum suction table after calibration. Further, the invention reduces the number of steps of operation for calibration as compared to the conventional calibration work, and therefore suppresses occurrence of downtime and a decrease in number of substrates processed per unit time. In addition, it is easy to conduct a regular check of apparatus condition through the calibration work, which stabilizes an apparatus condition of the bevel polishing apparatus.

According to one embodiment of the invention, there is provided a calibration method for a bevel polishing apparatus, comprising the steps of: providing a bevel polishing apparatus configured to polish a bevel portion of a substrate, the bevel polishing apparatus including: a vacuum suction table configured to hold the substrate placed thereon; and a plurality of polishing heads arranged along an outer periphery of the vacuum suction table, each polishing head of the plurality of polishing heads including a polishing pad adapted to be pressed toward the bevel portion of the substrate; sucking a base plate onto the vacuum suction table, the base plate being configured to have a load measuring device placed thereon; fixing the load measuring device to the base plate; rotating the vacuum suction table so as to position the load measuring device relative to the polishing head; applying a pressing force from the polishing pad to a load bearing surface of the load measuring device; and obtaining a correlation between a measured value of the load measuring device when the pressing force is applied and a set load of the polishing head.

DESCRIPTION OF EMBODIMENT

Embodiments of the invention will be explained below with reference to the attached drawings.

Figure 1:
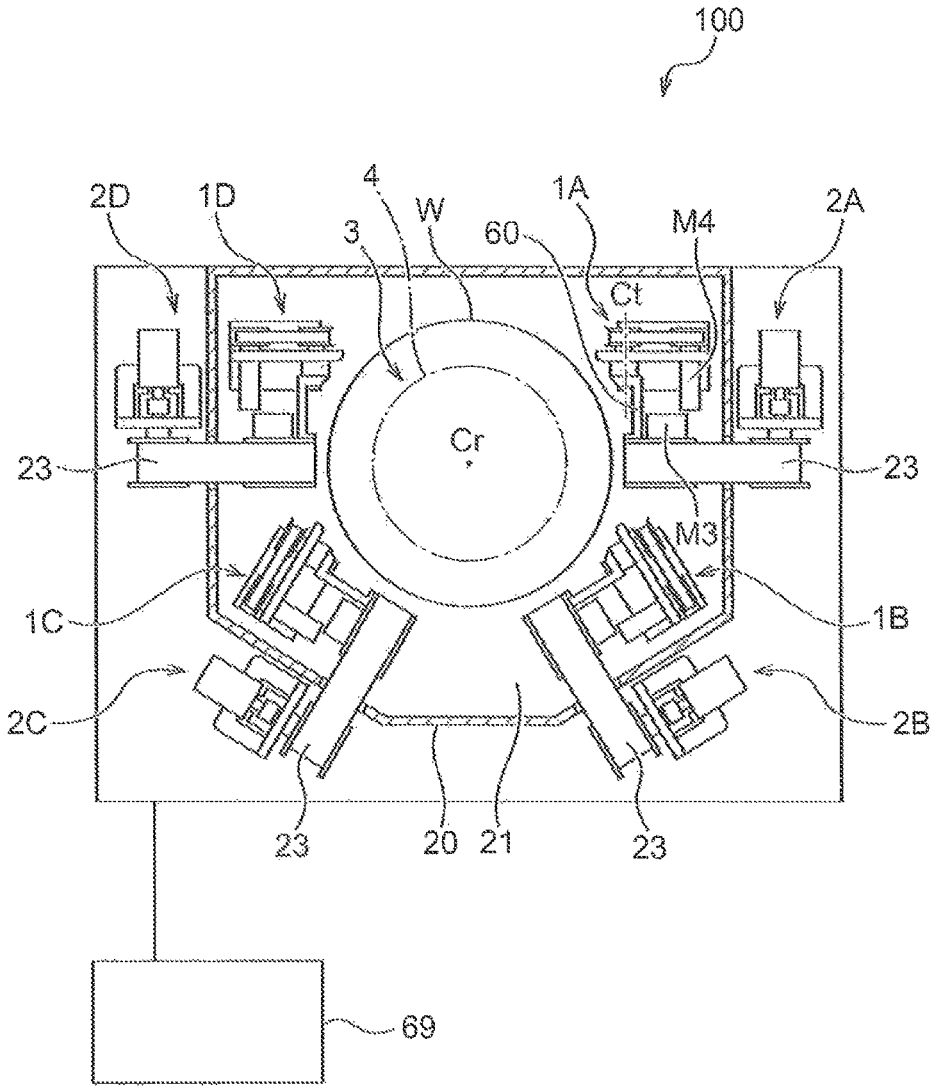
FIG. 1 shows one example of the entire configuration of a bevel polishing system to which the invention is applicable.

FIG. 1 is a plan view showing one example of the entire configuration of a bevel polishing system 100 to which the invention is applicable. The system shown in FIG. 1 comprises, in a central portion thereof, a rotating and holding mechanism 3 configured to horizontally hold and rotate a substrate W such as a wafer, which is a target to be polished. More specifically, the rotating and holding mechanism 3 includes a vacuum suction table 4 configured to hold a back surface of the substrate W by vacuum suction, and a shaft 5 (not shown in FIG. 1) attached to a central portion of the vacuum suction table 4. The shaft 5 is rotated by a motor, not shown, so as to rotate the substrate W around a central axis Cr of the vacuum suction table 4. Formed in the vacuum suction table 4 and the shaft 5 are vacuum passages into which negative pressure is introduced for sucking the substrate W onto the vacuum suction table 4.

Figure 12:
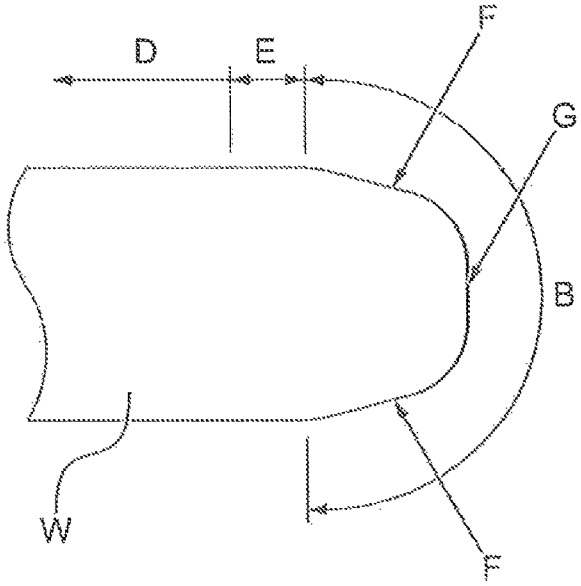
FIG. 12 is an enlarged sectional view of a peripheral edge portion of a substrate.

The bevel polishing system 100 is configured to polish a bevel portion of the substrate W, such as a wafer. FIG. 12 is a side view of a wafer which is horizontally placed on the vacuum suction table 4, and shows a peripheral edge portion of the wafer at an enlarged scale. In FIG. 12, a device is formed in a flat portion D of the wafer. The flat portion D is located on a radially inner side of the wafer at a distance of several millimeters from an end face G. The device is not formed in a flat portion E located outside the region D. In the present specification, a region B is referred to as a bevel portion. The region B has an angled surface extending from an upper inclined surface F located outside the flat portion E, through the end face G, to a lower inclined surface F.

As shown in FIG. 1, four polishing head assemblies 1A, 1B, 1C and 1D are disposed around the substrate W which is held by the rotating and holding mechanism 3. Disposed radially outside the polishing head assemblies 1A, 1B, 1C and 1D are tape feeding and collecting mechanisms 2A, 2B, 2C and 2D, which are configured to feed a polishing tape 23 as a polishing tool to the polishing head assemblies 1A, 1B, 1C and 1D, and collect the polishing tape 23 after being used. A partition wall 20 separates the polishing head assemblies 1A, 1B, 1C and 1D from the tape feeding and collecting mechanisms 2A, 2B, 2C and 2D. An interior space surrounded by the partition wall 20 forms a polishing chamber 21. The four polishing head assemblies 1A, 1B, 1C and 1D and the vacuum suction table 4 are disposed in the polishing chamber 21. The tape feeding and collecting mechanisms 2A, 2B, 2C and 2D are disposed outside the partition wall 20 (namely, outside the polishing chamber 21). The polishing head assemblies 1A, 1B, 1C and 1D are identically constructed, and the tape feeding and collecting mechanisms 2A, 2B, 2C and 2D are also identically constructed. Reference numeral 69 denotes an operation control portion for the bevel polishing system 100.

Figure 2:
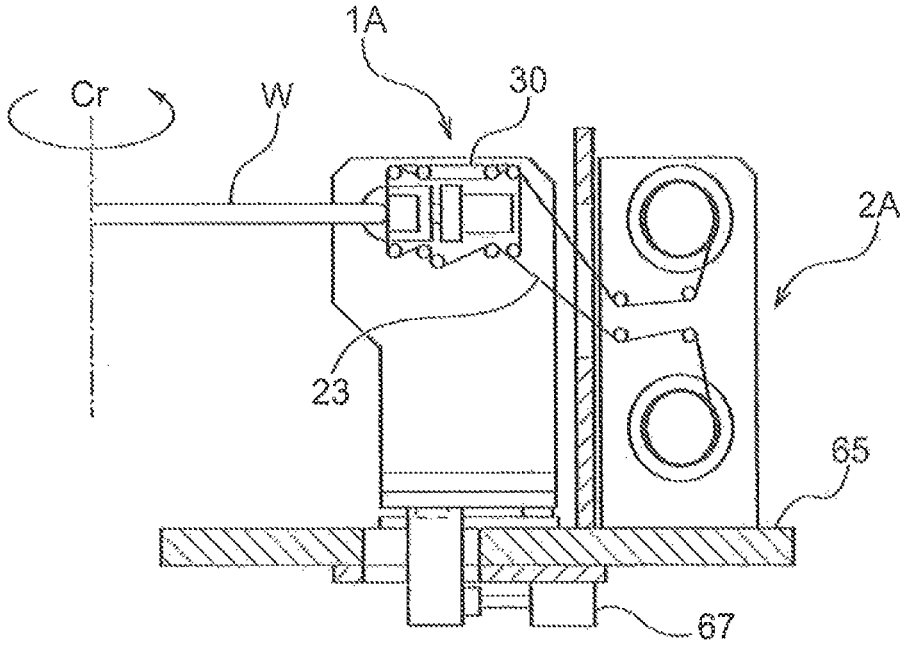
FIG. 2 is a sectional view schematically showing one example of an inner structure of a polishing head assembly and that of a tape feeding and collecting mechanism.

The polishing head assembly 1A has a polishing head 30 (not shown in FIG. 1) configured to bring the polishing tape 23, which is fed from the tape feeding and collecting mechanism 2A, into contact with a peripheral edge portion of the substrate W. FIG. 2 is a sectional view schematically showing an interior structure of the polishing head assembly 1A and that of the tape feeding and collecting mechanism 2A. As shown in FIG. 2, the polishing tape 23 is fed to the polishing head 30 in a manner such that a polishing surface of the polishing tape 23 faces the substrate W.

The polishing head 30 is fixed to one end of an arm 60 shown in FIG. 1. The arm 60 is configured to be rotatable around an axis Ct extending in parallel with a tangent line to the substrate W. The other end of the arm 60 is connected to a motor M4 through a pulley and a belt. When the motor M4 rotates clockwise and anticlockwise at a predetermined angle, the arm 60 rotates around the axis Ct at a predetermined angle. This makes it possible to change an inclination angle of the polishing head 30 in accordance with a shape of the bevel portion of the wafer W and then polish a desired part of the bevel portion of the substrate W.

As shown in FIG. 2, a forward and backward position of the polishing head 30 (in other words, a position along a radial direction of the substrate W) can be adjusted by a linear actuator 67 which is fixed directly or indirectly to a bottom plate 65.

Figure 3:
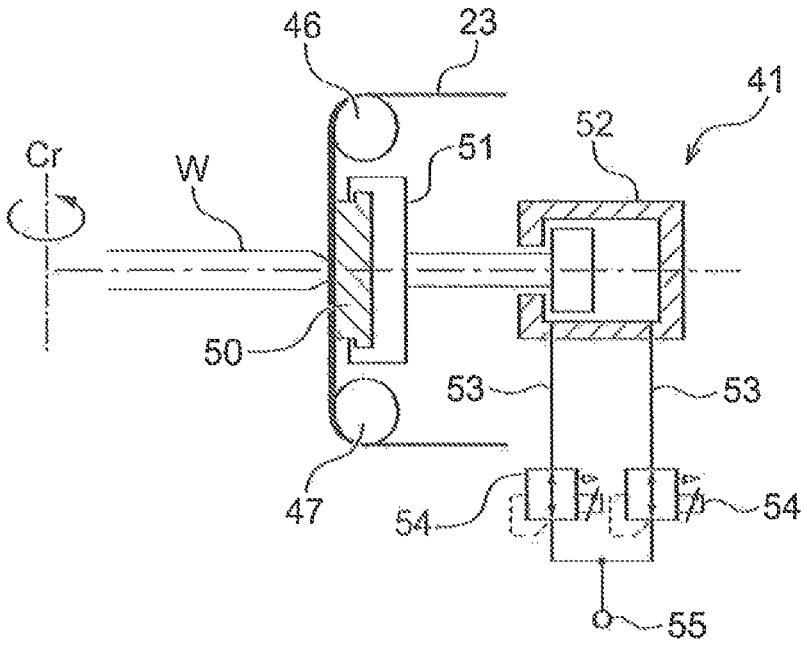
FIG. 3 is a view explaining one example of a pressing mechanism of a polishing head.

FIG. 3 is a view explaining one example of a pressing mechanism 41 of the polishing head 30. The pressing mechanism 41 includes a polishing pad 50 disposed on a back side of the polishing tape 23 supported by two guide rollers 46 and 47 vertically arranged in the front of the polishing head 30, a pad holder 51 configured to hold the polishing pad 50, and an air cylinder 52 configured to move the pad holder 51 toward the substrate W.

The air cylinder 52 is a so-called single-rod cylinder. Two air conduits 53 are connected to the air cylinder 52 through two ports. Each of the air conduits 53 is provided with an electropneumatic regulator (an electromagnetic valve, for example) 54. A primary side of each electropneumatic regulator 54 is connected to an air supply source (a compressor, for example) 55, and a secondary side of each electropneumatic regulator 54 is connected to the corresponding port of the air cylinder 52. The electropneumatic regulator 54 is controlled according to a signal transmitted from the operation control portion 69, so as to enable an air pressure supplied to the air cylinder 52 to be adjusted to desired pressure. To be more specific, the operation control portion 69 controls the electropneumatic regulator 54 so as to generate a pressing force equal to a set value entered by an operator. The control on the air pressure supplied to the air cylinder 52 makes it possible to push the polishing pad 50 connected to a piston rod of the air cylinder 52, and control the pressure for pressing the polishing surface of the polishing tape 23 against the wafer W.

Figure 4:
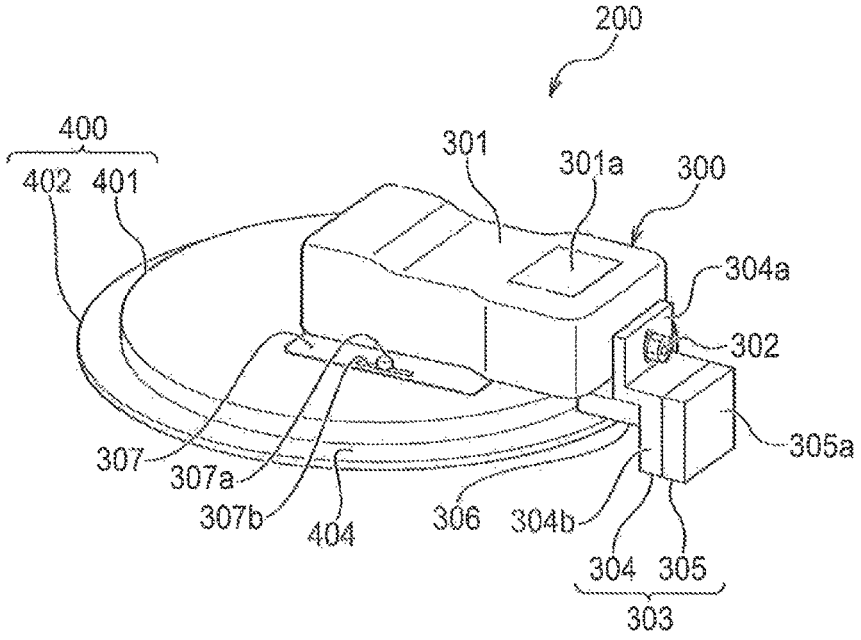
FIG. 4 is an upper perspective view of a calibration apparatus according to one embodiment of the invention.
Figure 5:
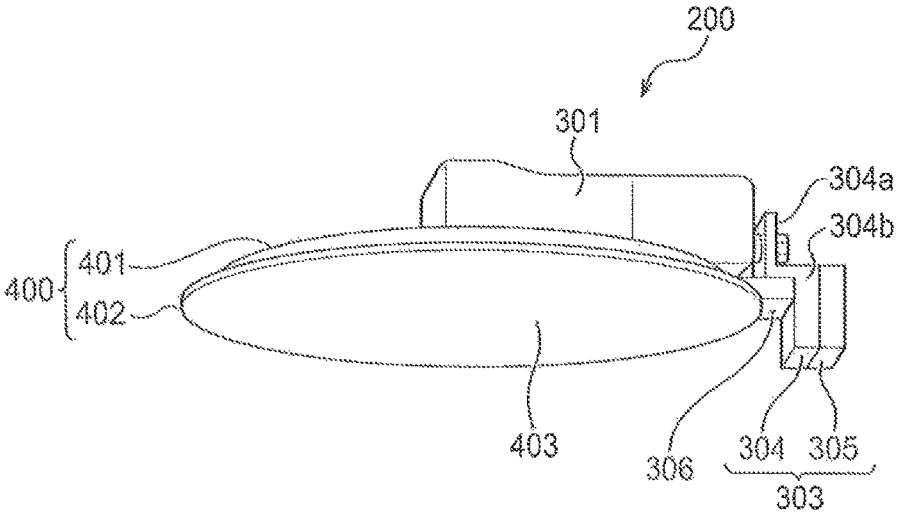
FIG. 5 is a lower perspective view of the calibration apparatus shown in FIG. 4.
Figure 6:
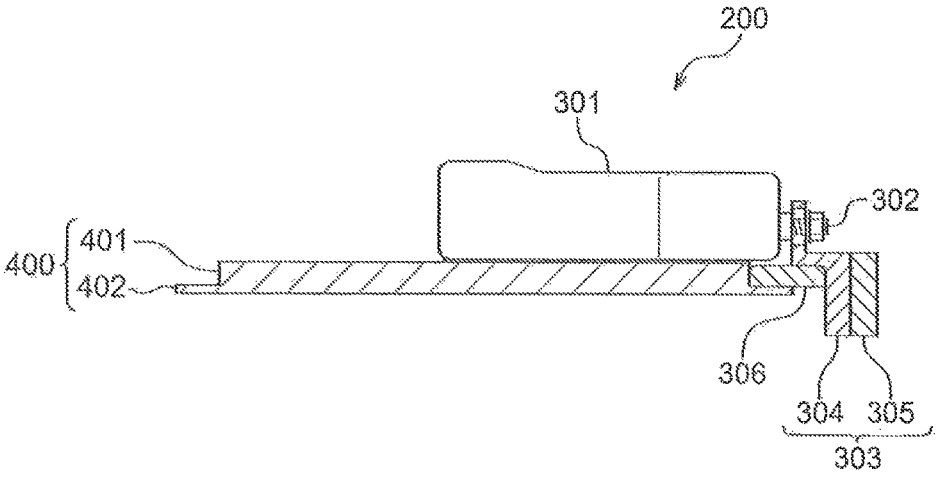
FIG. 6 is a side sectional view of the calibration apparatus shown in FIG. 4.

A calibration apparatus 200 according to one embodiment of the invention is applicable to, for example, the bevel polishing system 100 constructed as described above. FIG. 4 is a top perspective view of the calibration apparatus 200 according to one embodiment of the invention. FIG. 5 is a bottom perspective view of the calibration apparatus 200 shown in FIG. 4. FIG. 6 is a side sectional view of the calibration apparatus 200. The calibration apparatus 200 includes a load measuring device 300 capable of measuring a pressing load from the polishing pad 50 of the bevel polishing system 100, and a base plate 400 on which the load measuring device 300 can be placed. The base plate 400 can be fixed on the vacuum suction table 4 of the bevel polishing system 100. In the example illustrated, the load measuring device 300 comprises a force gauge 301. According to the present example, the force gauge 301 is a digital force gauge. Reference numeral 301*a* denotes a display window on which a measured value is digitally indicated. The embodiments of the invention, however, are not limited to this example.

Figure 7:
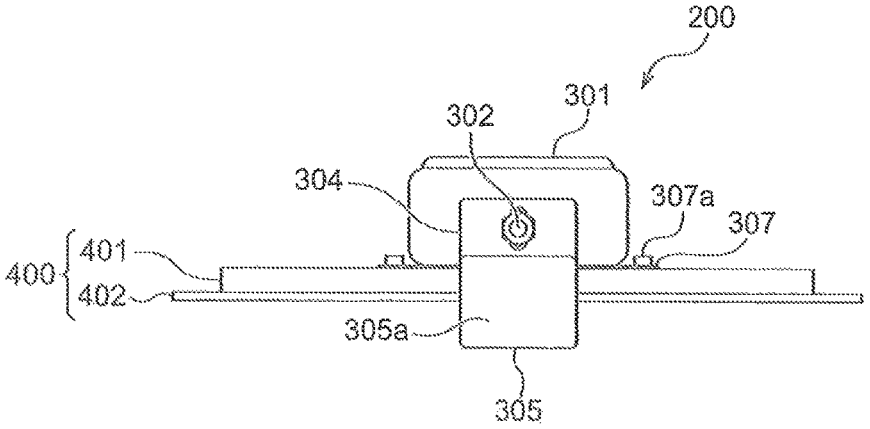
FIG. 7 is an end view of the calibration apparatus of FIG. 4, as viewed from the polishing head.

According to the example illustrated, the base plate 400 is arranged so as to comprise substantially circular plate-like members different in diameter, which are coaxially arranged in a vertical direction. The base plate 400 includes an upper plate portion 401 with a small diameter and a lower plate portion 402 with a large diameter. It is preferable that the lower plate portion 402 be substantially identical in diameter to the vacuum suction table 4. The base plate 400 needs to be coaxially disposed on the vacuum suction table 4. Therefore, by arranging the lower plate portion 402 and the vacuum suction table 4 to have the same outer contour, the positioning when the base plate 400 is sucked onto the vacuum suction table 4 can be facilitated. A back surface 403 of the lower plate portion 402 is made flat so as to enable the lower plate portion 402 to be easily fixed onto the vacuum suction table 4 by suction. The force gauge 301 is placed on the upper plate portion 401 in a manner such that a measuring shaft 302 extending from a main body of the force gauge 301 can be oriented toward the polishing head 30 disposed around the base plate 400. FIG. 7 is an end view of the calibration apparatus 200, as viewed from the polishing head 30.

The load measuring device 300 may comprise a load bearing member 303 which can be fixed to the measuring shaft 302 of the force gauge 301. According to the example shown in the drawing, the load bearing member 303 has a bracket 304. The bracket 304 has an attachment portion 304*a* adapted to be attached to the measuring shaft 302, and a load bearing portion 304*b* including a load bearing surface (reference numeral omitted) configured to be capable of receiving a pressing load from the polishing pad 50. The bracket 304 can be fixed to the measuring shaft 302 through the attachment portion 304*a* by means of a bolt and a nut.

According to the example shown in the drawing, the load bearing member 303 has a pad 305 formed by a resin (PEEK, for example) and adapted to be fixed to the load bearing surface of the bracket 304 made of a metal. The pad 305 can be fixed by means of a bolt that is attachable from a rear side of the load bearing portion 304*b* of the bracket 304. When the metal bracket 304 makes direct contact with the polishing pad 50, metal contamination (in other words, metal pollution) of the polishing pad 50 is likely to occur. The resin pad 305 is advantageous in preventing such metal contamination. The use of the resin pad 305 also minimizes a risk such that the resin polishing pad 50 will be damaged when it is pressed against the load bearing surface during calibration. In other embodiments of the invention, however, the resin pad 305 may be omitted.

In this specification, in the case where the pad 305 is attached to the load bearing portion 304*b* of the bracket 304 as illustrated, a surface of the pad 305 in the attached position provides the "load bearing surface" of the load bearing member 303. In the case where the pad 305 is not attached to the load bearing portion 304*b*, a surface of the bracket 304 provides the "load bearing surface" of the load bearing member 303. Hereinafter, the term "load bearing surface" covers both cases.

According to the example illustrated, the calibration apparatus 200 includes a spacer 306. The spacer 306 can be detachably disposed in a stepped portion 404 formed between the upper plate portion 401 and the lower plate portion 402. The spacer 306 preferably has one end portion thereof shaped so as to conform to an outer peripheral surface of the upper plate portion 401. It is possible to adjust the position of the load bearing surface 305*a* relative to the base plate 400, and therefore the vacuum suction table 4 to which the base plate 400 is fixed, by bringing the load bearing portion 304*b* of the bracket 304 into contact with the other end portion of the spacer 306.

The load measuring device 300 may have a mounting plate 307 which can be fixed to the base plate 400. The force gauge 301 can be fixed to the base plate 400 through the mounting plate 307. The mounting plate 307 may be previously fixed to the main body of the force gauge 301.

The mounting plate 307 has an adjustment screw 307*a* capable of adjusting a position of the mounting plate 307 relative to the base plate 400. In this case, the mounting plate 307, for example, may have a slot 307*b* extending in a direction which is substantially the same as the direction of extension of the measuring shaft 302, and the upper plate portion 401 may have a slot that can be so disposed as to face the slot 307*b*. The adjustment screw 307*a* may be fastened to the base plate 400 at a desired position within the slots.

Figure 8:
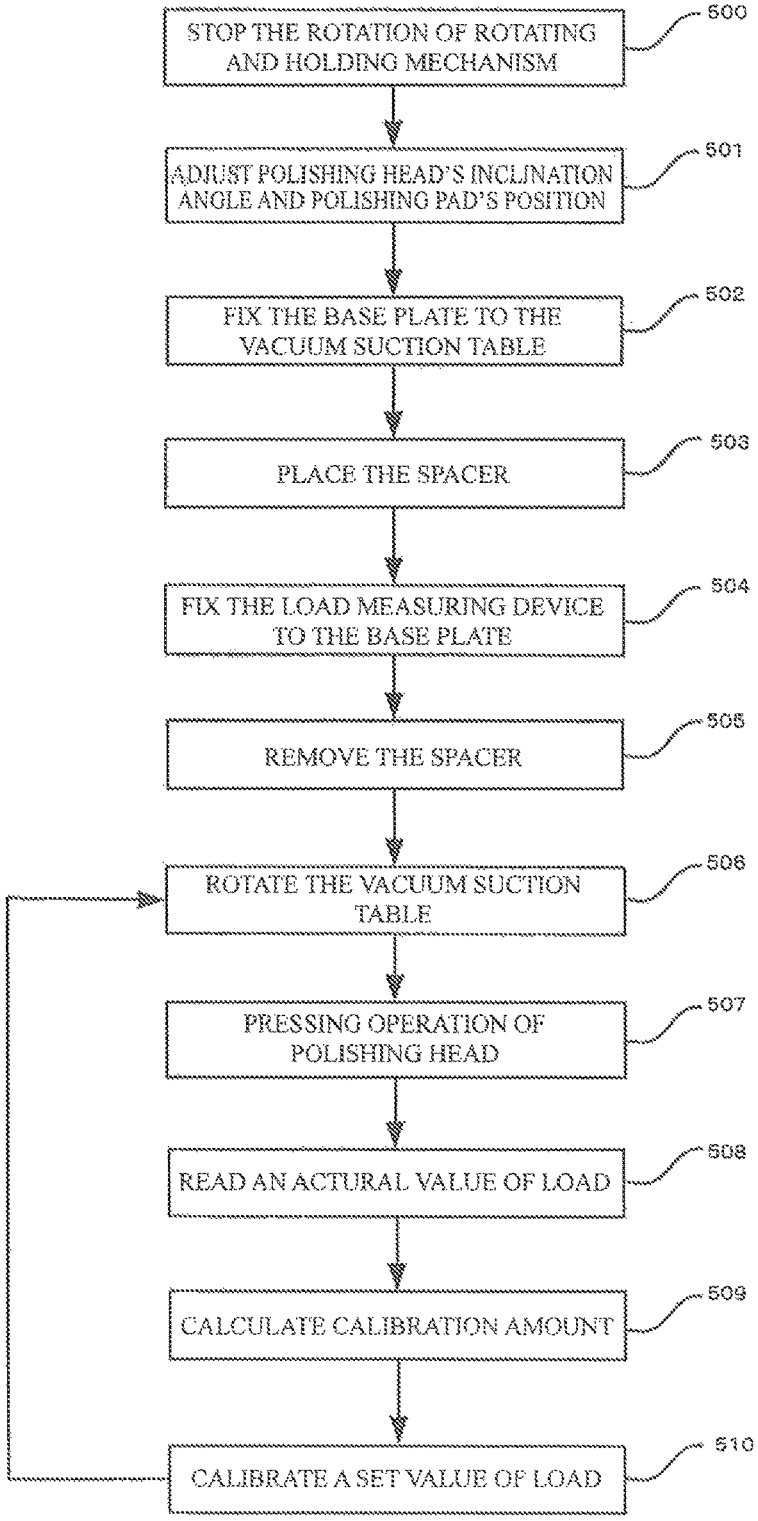
FIG. 8 is a flowchart showing a calibration method according to one embodiment of the invention.
Figure 9:
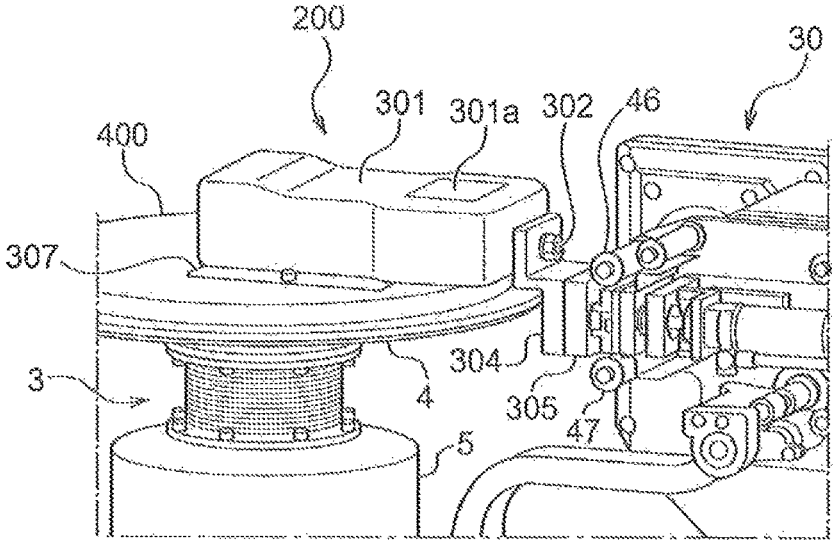
FIG. 9 is a view showing a state in which a calibration apparatus according to one embodiment of the invention is being used.
Figure 10:
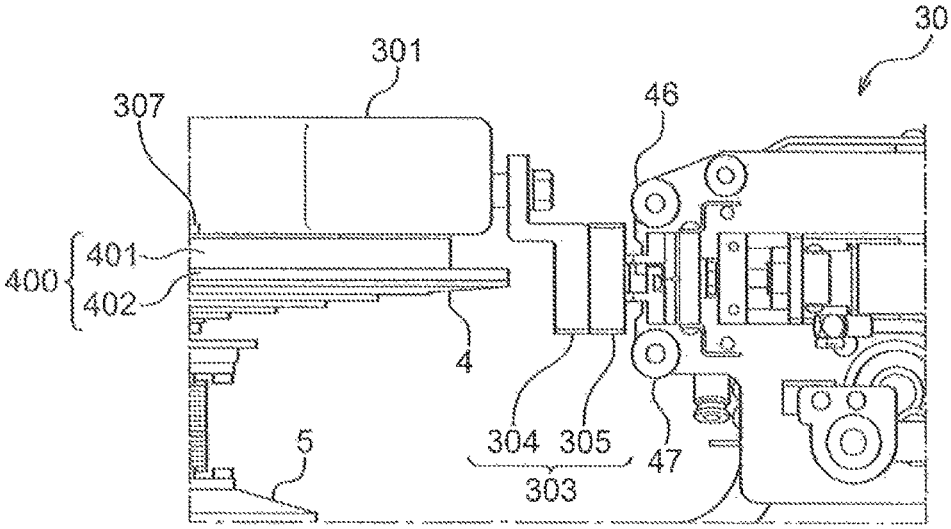
FIG. 10 is a view showing a state in which a calibration apparatus according to one embodiment of the invention is being used.
Figure 11:
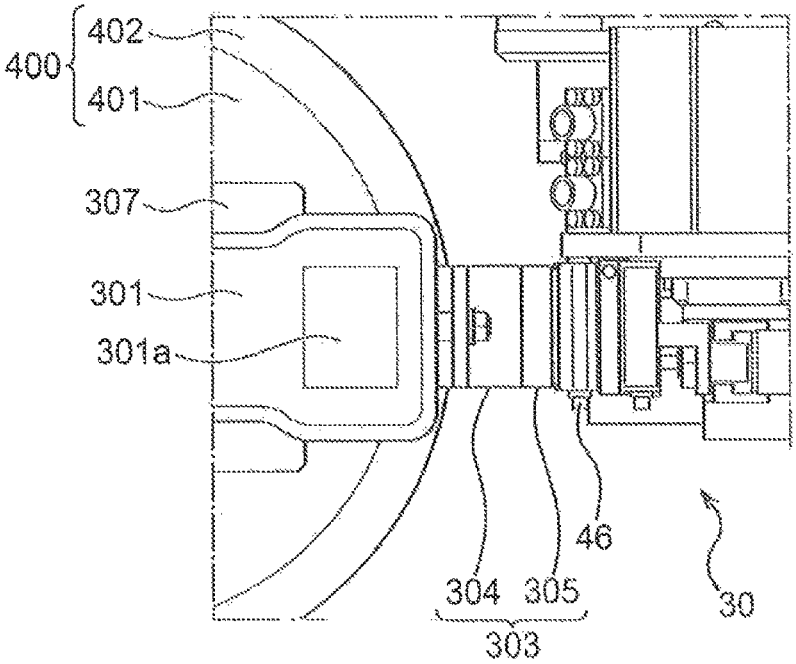
FIG. 11 is a view showing a state in which a calibration apparatus according to one embodiment of the invention is being used.

The calibration apparatus 200 thus configured as illustrated is used to perform the calibration of the bevel polishing system 100, for example, by a method described below. FIG. 8 is a flowchart showing an example of a calibration method, which will be explained below. FIGS. 9 to 11 are perspective, side, and top views showing a state in which the calibration apparatus 200 is being used. In FIGS. 9 to 11, the polishing tape 23 is omitted from the drawings.

First, the rotation of the rotating and holding mechanism 3 of the bevel polishing system 100 is stopped (Step 500). The polishing heads 30 of the polishing head assemblies 1A, 1B, 1C and 1D are each adjusted to have an inclination angle of zero degree (that is, adjusted to a horizontal direction as shown in FIG. 2), while forward and backward positions of the polishing pads 50 are each adjusted to a predetermined polishing position (Step 501). In the subsequent step, the base plate 400 is fixed onto the vacuum suction table 4 by suction in a manner such that an outer periphery of the vacuum suction table 4 coincides with that of the base plate 400 (that is, the central axis of the vacuum suction table 4 coincides with that of the base plate 400) (Step 502). In this instance, it is preferable that the load measuring device 300 be temporarily fixed on the upper plate portion 401 without firmly fastening the adjustment screw 307*a* of the mounting plate 307. In order to adjust the position of the load bearing surface 305*a* of the load measuring device 300 relative to the vacuum suction table 4, the spacer 306 is disposed between the load bearing surface 305*a* and the base plate 400 (Step 503). To be specific, one end portion of the spacer 306 is disposed in the stepped portion 404 of the base plate 400, and the other end portion of the spacer 306 is brought into contact with the load bearing portion 304*b* of the bracket 304. Distance between the central axis of the base plate 400, that is, the central axis of the vacuum suction table 4, and the load bearing surface 305*a* of the pad 305 may be, for example, 150 mm. By fastening the adjustment screw 307*a* in the above-described state, the load measuring device 300 is fixed on the upper plate portion 401 (Step 504). After the fixation, the spacer 306 is slid along the stepped portion 404 and removed (Step 505).

The vacuum suction table 4 may be, for example, manually rotated so that the load bearing surface 305*a* can be positioned relative to, for example, the polishing pad 50 of the polishing head assembly 1A (in other words, the load bearing surface 305*a* can be made parallel with a surface of the polishing pad 50) (Step 506). In this instance, tension in the polishing tape 23 of the polishing head 30 may be reduced.

After the positioning, an operator enters the set value of the pressing force into the operation control portion 69 of the bevel polishing system 100 so as to operate the polishing head 30 (Step 507). As a result, the polishing pad 50 is pressed against the load bearing surface 305*a* of the pad 305 fixed to the measuring shaft 302 of the force gauge 301. With regard to the pad 305 which has been pressed, an actual measurement value of load, which is indicated on the display window 301*a* of the force gauge 301, is read (Step 508). Then, an amount of calibration is calculated by making comparison between the actual measurement value and the set value (Step 509). The set value is calibrated in accordance with the calculation result (Step 510). Specifically, the calibration is carried out so as to reduce the set value if the actual measurement value is larger than the set value, and the calibration is carried out so as to increase the set value if the actual measurement value is smaller than the set value. If the actual measurement value is equal to the set value, the calibration is not carried out.

In the subsequent step, the vacuum suction table 4 is rotated so as to position the load bearing surface 305*a* relative to, for example, the polishing pad 50 of the polishing head assembly 1B (Step 506). Thus, steps 506 to 510 are also performed with respect to the rest of the polishing head assemblies, namely, the polishing head assemblies 1B, 1C and 1D in the above-described manner, to thereby adjust the pressing force with respect to each of the polishing pads 50 of the bevel polishing system 100.

The calibration apparatus 200 according to an embodiment of the invention can be used to not only set the polishing load but also check the load as routine or for regular maintenance. In the event of a failure of a component, which affects the polishing load, for example, when a set pressure of the electropneumatic regulator falls outside a proper range, the load can be easily readjusted using the calibration apparatus 200 after restoration.

Thus, according to an embodiment of the invention, by using the suction mechanism of the existing vacuum suction table 4, the calibration apparatus 200 can be mounted on the rotating and holding mechanism 3 without removal of the vacuum suction table 4. As compared to conventional calibration work, therefore, the mounting of the calibration apparatus 200 can be easily conducted. This reduces a risk of occurrence of human error during the mounting of the calibration apparatus 200. Furthermore, differing from the conventional art, there is no possibility of occurrence of human error accompanying the mounting of the vacuum suction table 4 after the calibration is finished.

The invention reduces the number of steps of operation for calibration, as compared to the conventional calibration work, and therefore suppresses occurrence of downtime and a decrease in number of substrates processed per unit time. Further, the invention enables an easy regular check of the apparatus condition through the calibration work. This stabilizes the condition of the bevel polishing system 100.

The present invention includes the following embodiments.

1. A calibration apparatus for use in a bevel polishing apparatus, the bevel polishing apparatus being configured to polish a bevel portion of a substrate, the calibration apparatus comprising: a load measuring device configured to measure a pressing load from a polishing pad of the bevel polishing apparatus; and a base plate configured to be fixed on a vacuum suction table configured to hold the substrate placed thereon, the base plate having the load measuring device placed thereon. With the above arrangement, the calibration apparatus can be mounted on a mechanism for rotating a substrate by using the suction mechanism of an existing vacuum suction table. This eliminates the necessity of removal of the vacuum suction table which is required in the conventional art. Since the mounting of the calibration apparatus can be easily conducted as compared to the conventional calibration work, a risk of occurrence of human error during the mounting of the calibration apparatus can be reduced. Further, differing from the conventional art, there is no possibility of human error accompanying the mounting of the vacuum suction table after calibration. Further, the invention reduces the number of steps of operation for calibration as compared to the conventional calibration work, and therefore suppresses occurrence of downtime and a decrease in number of substrates processed per unit time. In addition, it is easy to conduct a regular check of apparatus condition through the calibration work, which stabilizes a apparatus condition of the bevel polishing apparatus.

2. The calibration apparatus described in item 1 above, wherein the load measuring device includes a force gauge having a measuring shaft.

3. The calibration apparatus described in item 2 above, wherein the load measuring device includes a load bearing member configured to be fixed to the measuring shaft of the force gauge, the load bearing member including a load bearing surface configured to receive the pressing load.

4. The calibration apparatus described in item 3 above, further comprising a spacer configured to adjust a position of the load bearing surface relative to the vacuum suction table.

5. The calibration apparatus described in item 3 or 4 above, wherein the load bearing member includes a bracket.

6. The calibration apparatus described in item 5 above, wherein the load bearing member includes a pad formed by a resin and adapted to be fixed to the bracket.

7. The calibration apparatus described in any one of items 1 to 6 above, wherein the load measuring device includes a mounting plate, the mounting plate being configured to be fixed to the base plate.

8. The calibration apparatus described in item 7 above, wherein the mounting plate includes an adjustment screw configured to adjust a position of the mounting plate relative to the base plate.

9. A bevel polishing apparatus configured to polish a bevel portion of a substrate, the bevel polishing apparatus comprising: a vacuum suction table configured to hold a substrate placed thereon; a plurality of polishing heads arranged along an outer periphery of the vacuum suction table, each polishing head of the plurality of polishing heads including a polishing pad adapted to be pressed toward a bevel portion of the substrate; and the calibration apparatus described in any one of items 1 to 8 above.

10. A calibration method for a bevel polishing apparatus, comprising the steps of: providing a bevel polishing apparatus configured to polish a bevel portion of a substrate, the bevel polishing apparatus including: a vacuum suction table configured to hold the substrate placed thereon; and a plurality of polishing heads arranged along an outer periphery of the vacuum suction table, each polishing head of the plurality of polishing heads including a polishing pad adapted to be pressed toward the bevel portion of the substrate; sucking a base plate onto the vacuum suction table, the base plate being configured to have a load measuring device placed thereon; fixing the load measuring device to the base plate; rotating the vacuum suction table so as to position the load measuring device relative to the polishing head; applying a pressing force from the polishing pad to a load bearing surface of the load measuring device; and obtaining a correlation between a measured value of the load measuring device when the pressing force is applied and a set load of the polishing head.

11. The calibration method described in item 10 above, the step of fixing the load measuring device to the base plate includes a step of providing a spacer between the load bearing surface of the load measuring device and the base plate, to thereby adjust a position of the load bearing surface relative to the vacuum suction table.

12. The calibration method described in item 11 above, the step of sucking the base plate onto the vacuum suction table includes temporarily fixing a mounting plate of the load measuring device to the base plate.

Although the embodiments of the present invention have been described above based on some examples, the described embodiments are for the purpose of facilitating the understanding of the present invention and are not intended to limit the present invention. The present invention may be modified and improved without departing from the spirit thereof, and the invention includes equivalents thereof. In addition, the elements described in the claims and the specification can be arbitrarily combined or omitted within a range in which the above-mentioned problems are at least partially solved, or within a range in which at least a part of the advantages is achieved.

This application claims priority under the Paris Convention to Japanese Patent Application No. 2015-231844 filed on Nov. 27, 2015. The entire disclosure of Japanese Patent Application No. 2015-231844 filed on Nov. 27, 2015 including specification, claims, drawings and summary is incorporated herein by reference in its entirety. The entire disclosure of Japanese Patent Application No. 2012-231191 (Patent Document 1) including specification, claims, drawings and summary is incorporated herein by reference in its entirety.

INDUSTRIAL APPLICABILITY

The invention is widely applicable to bevel polishing systems for polishing the bevel portions of substrates.

REFERENCE SIGNS LIST

3 rotating and holding mechanism
4 vacuum suction table
5 shaft
1A, 1B, 1C, 1D polishing head assembly
2A, 2B, 2C, 2D tape feeding and collecting mechanism
20 partition wall
21 polishing chamber
23 polishing tape
30 polishing head
41 pressing mechanism
46, 47 guide roller
50 polishing pad
51 pad holder
52 air cylinder
53 air conduit
54 electropneumatic regulator
55 air supply source
60 arm
65 bottom plate
67 linear actuator
69 operation control portion
100 bevel polishing system
200 calibration apparatus
300 load measuring device
301 force gauge
301*a* display window
302 measuring shaft
303 load bearing member
304 bracket
304*a* attachment portion
304*b* load bearing portion
305 pad
305*a* load bearing surface
306 spacer
307 mounting plate
307*a* adjustment screw
307*b* slot
400 base plate
401 upper plate portion
402 lower plate portion
403 back surface
404 stepped portion
B bevel portion
Cr, Ct axis
M3, M4 motor
W substrate

What is claimed is:

1. A calibration apparatus for use in a bevel polishing apparatus, the bevel polishing apparatus being configured to polish a bevel portion of a substrate, said calibration apparatus comprising:

a load measuring device configured to measure a pressing load from a polishing pad of the bevel polishing apparatus; and a base plate configured to be fixed on a vacuum suction table configured to hold the substrate placed thereon, the base plate having the load measuring device placed thereon.

2. The calibration apparatus according to claim 1, wherein the load measuring device includes a force gauge having a measuring shaft.

3. The calibration apparatus according to claim 2, wherein the load measuring device includes a load bearing member configured to be fixed to the measuring shaft of the force gauge, the load bearing member including a load bearing surface configured to receive the pressing load.

4. The calibration apparatus according to claim 3, further comprising a spacer configured to adjust a position of the load bearing surface relative to the vacuum suction table.

5. The calibration apparatus according to claim 3, wherein the load bearing member includes a bracket.

6. The calibration apparatus according to claim 5, wherein the load bearing member includes a pad formed by a resin and adapted to be fixed to the bracket.

7. The calibration apparatus according to claim 1, wherein the load measuring device includes a mounting plate, the mounting plate being configured to be fixed to the base plate.

8. The calibration apparatus according to claim 7, wherein the mounting plate includes an adjustment screw configured to adjust a position of the mounting plate relative to the base plate.

9. A bevel polishing apparatus configured to polish a bevel portion of a substrate, the bevel polishing apparatus comprising:

a vacuum suction table configured to hold a substrate placed thereon;

a plurality of polishing heads arranged along an outer periphery of the vacuum suction table, each polishing head of the plurality of polishing heads including a polishing pad adapted to be pressed toward a bevel portion of the substrate; and a calibration apparatus, the calibration apparatus including:

a load measuring device configured to measure a pressing load from a polishing pad of the bevel polishing apparatus; and a base plate configured to be fixed on a vacuum suction table configured to hold the substrate placed thereon, the base plate having the load measuring device placed thereon.

10. The bevel polishing apparatus according to claim 9, wherein the load measuring device includes a force gauge having a measuring shaft.

11. The bevel polishing apparatus according to claim 10, wherein the load measuring device includes a load bearing member configured to be fixed to the measuring shaft of the force gauge, the load bearing member including a load bearing surface configured to receive the pressing load.

12. The bevel polishing apparatus according to claim 11, wherein the calibration apparatus further comprises a spacer configured to adjust a position of the load bearing surface relative to the vacuum suction table.

13. The bevel polishing apparatus according to claim 11, wherein the load bearing member includes a bracket.

14. The bevel polishing apparatus according to claim 13, wherein the load bearing member includes a pad formed by a resin and adapted to be fixed to the bracket.

15. The bevel polishing apparatus according to claim 9, wherein the load measuring device includes a mounting plate configured to be fixed to the base plate.

16. The bevel polishing apparatus according to claim 15, wherein the mounting plate includes an adjustment screw configured to adjust a position of the mounting plate relative to the base plate.

17. A calibration method for a bevel polishing apparatus, comprising the steps of:

providing a bevel polishing apparatus configured to polish a bevel portion of a substrate, the bevel polishing apparatus including: a vacuum suction table configured to hold the substrate placed thereon; and a plurality of polishing heads arranged along an outer periphery of the vacuum suction table, each polishing head of the plurality of polishing heads including a polishing pad adapted to be pressed toward the bevel portion of the substrate;

sucking a base plate onto the vacuum suction table, the base plate being configured to have a load measuring device placed thereon;

fixing the load measuring device to the base plate;

rotating the vacuum suction table so as to position the load measuring device relative to the polishing head;

applying a pressing force from the polishing pad to a load bearing surface of the load measuring device; and obtaining a correlation between a measured value of the load measuring device when the pressing force is applied and a set load of the polishing head.

18. The calibration method according to claim 17, wherein the step of fixing the load measuring device to the base plate includes a step of providing a spacer between the load bearing surface of the load measuring device and the base plate, to thereby adjust a position of the load bearing surface relative to the vacuum suction table.

19. The calibration method according to claim 18, wherein the step of sucking the base plate onto the vacuum suction table includes temporarily fixing a mounting plate of the load measuring device to the base plate.

* * * * *